United States Patent [19]

Agner

[11] Patent Number: 4,869,381

[45] Date of Patent: Sep. 26, 1989

[54] INFANT FEEDER AND SUPPORT THEREFOR

[76] Inventor: Ann H. Agner, 2426 S. Stratford Dr., Owensboro, Ky. 42301

[21] Appl. No.: 190,957

[22] Filed: May 6, 1988

[51] Int. Cl.[4] ..... A61J 9/04; A61J 9/06; A47G 23/02

[52] U.S. Cl. ..... 215/11.1; 215/6; 222/173; 248/102; 248/363

[58] Field of Search ..... 215/11.1–11.6, 215/100.5, 100.6; 248/105, 106, 102, 362, 363, 206.2, 103, 104, 359 A, 346.1, 309.3; 220/85 H, 90.2; 222/173

[56] References Cited

U.S. PATENT DOCUMENTS

| | | | |
|---|---|---|---|
| 950,710 | 3/1910 | Williams | 215/11.1 |
| 1,801,835 | 4/1931 | Andrews | 248/362 |
| 2,108,863 | 2/1938 | Kieft | 248/362 |
| 2,303,997 | 12/1942 | Hogg | 215/11.1 |
| 2,469,489 | 5/1949 | Allen et al. | 215/11.1 |
| 2,654,556 | 10/1953 | Lathrop | 248/105 |
| 2,746,702 | 5/1956 | Gourley et al. | 248/105 |
| 2,881,999 | 4/1959 | Mitchell | 248/106 |
| 2,912,200 | 11/1959 | Reinhorn | 248/103 |
| 2,989,278 | 6/1961 | Hyman | 248/106 X |
| 3,093,256 | 6/1963 | Woodbury, Jr. | 215/11.1 |
| 4,093,165 | 6/1978 | Sussman | 248/106 |
| 4,416,438 | 11/1983 | King | 248/102 |

FOREIGN PATENT DOCUMENTS

| | | | |
|---|---|---|---|
| 2443586 | 3/1976 | Fed. Rep. of Germany | 248/363 |

OTHER PUBLICATIONS

Product description of "The First Years Baby Food Trainer", The First Years, Avon, MA, 1983.

Product description of "Infant Feeder", Playschool Baby, Inc. Northvale, NJ, 1986.

Product description of "The Original Infa Feeder", Infa Division of Sassy, Inc., Grand Rapids, MI 49507 (undated).

*Primary Examiner*—Sue A. Weaver

*Attorney, Agent, or Firm*—Fleit, Jacobson, Cohn, Price, Holman & Stern

[57] ABSTRACT

This invention relates to a support for an infant feeder. The infant feeder itself comprises a hollow receptacle formed by an endless side wall extending in a longitudinal direction and having caps disposed at first and second ends thereof. A floating wall is disposed within the hollow receptacle and divides the interior of the hollow receptacle into a strained food receiving chamber and an air receiving chamber. A nipple is mounted on one of the caps at the first end of the receptacle. Food is supplied from the strained food receiving chamber to an infant through the nipple. A peg is molded or otherwise rigidly affixed to the other of the caps at the second end of the hollow receptacle. The peg extends substantially perpendicularly to a flat base portion of the other of the caps. A suction member forming the support for the feeder is removably secured to a surface on which the feeder is to be mounted. The suction member includes a suction cup portion and an upstanding central portion including a longitudinal bore formed therein. The peg is inserted into and interlocked with the longitudinal central bore either by friction or by a circumferentially extending rib received in a corresponding recess within the bore to securely mount the infant feeder on the surface.

6 Claims, 1 Drawing Sheet

FIG. 1
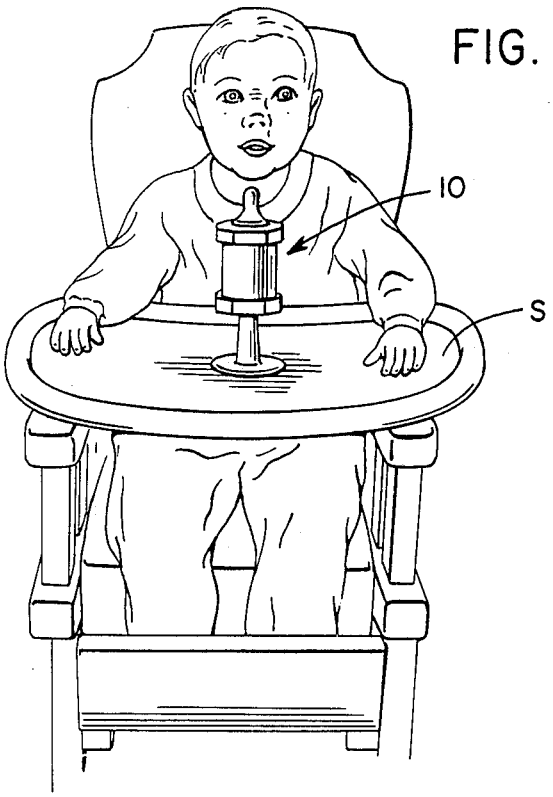
FIG. 2
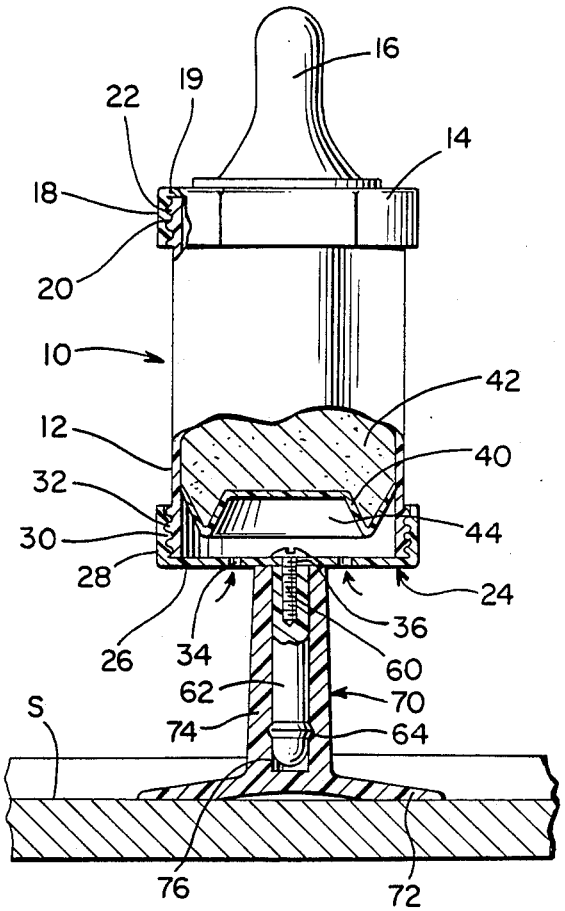
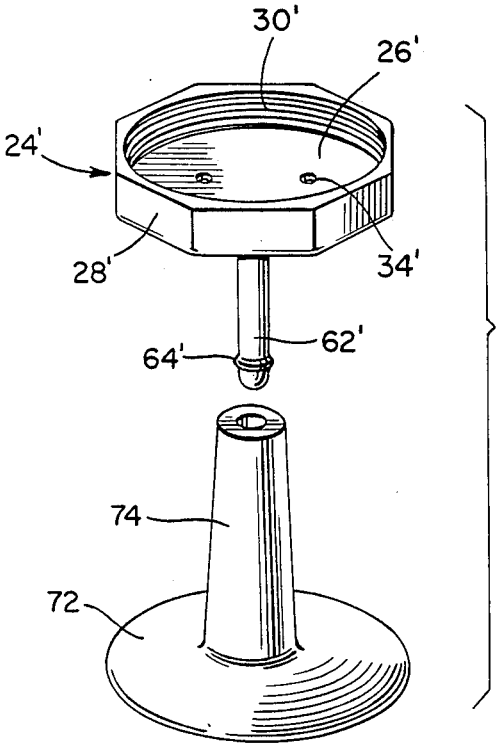
FIG. 3
FIG. 4
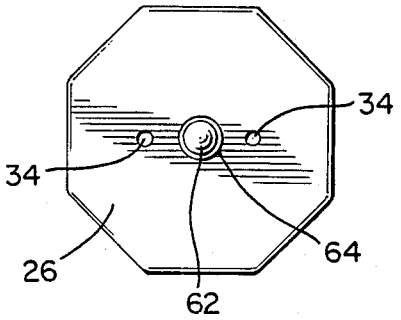

INFANT FEEDER AND SUPPORT THEREFOR

BACKGROUND OF THE INVENTION

1. Field of the Invention

This invention relates to a support for an infant feeder which may be used to supply strained baby foods and cereals or liquids to an infant or child.

2. Description of the Related Art

U.S. Pat. No. 950,710 to H. D. Williams discloses a nursing bottle including a rod 10 having a broad base secured to the outer end thereof. A movable false bottom including disks which fit the bore of the bottle is provided. In use, as a child draws milk from the bottle, the suction created by the child causes the false bottom to move upwardly so that the portion of the bottle between the nipple and the false bottom is always filled with milk.

The nursing bottle of this patent has several disadvantages. If the bottle is inadvertently bumped by the child, the base may not provide the bottle with sufficient stability to prevent the bottle from falling to the ground and becoming damaged. Additionally, the bottom cap, rod, base and disk of the bottle of this patent are constructed as a unit which is cumbersome and which may be difficult to clean.

U.S. Pat. No. 2,989,278 to A. Hyman discloses a nursing bottle holder including open members rigidly attached to the top of a rod. The bottom of the rod is attached to a suction cup so that the bottle holder can be anchored securely upright to the tray of a high chair.

A possible disadvantage may arise when the nursing bottle of this patent is used. Due to the angular orientation of the bottle relative to the holder, the liquid contained within the bottle will flow towards the nipple and the weight of the liquid within the bottle will tend to cause the bottle to become unstable and tip over. Moreover, since the rod is connected only at its very end to the suction cup, the suction cup may not resist tipping of the bottle sufficiently to prevent the bottle and holder from tipping over.

SUMMARY OF THE INVENTION

It is accordingly an object of the instant invention to provide an improved support for an infant feeder which is simply constructed and allows the infant feeder to be easily disassembled for cleaning. The infant feeder support provides the infant feeder with increased stability so that it is unlikely to be knocked over or bumped off of a surface upon which the infant feeder is mounted The infant feeder itself comprises a hollow receptacle formed by an endless side wall extending in a longitudinal direction and having caps disposed at first and second ends thereof A floating wall is disposed within the hollow receptacle and divides the interior of the hollow receptacle into a consumable material receiving chamber and an air receiving chamber. A nipple is mounted on one of the caps at the first end of the receptacle. Strained food is typically supplied from the consumable material receiving chamber to an infant through the nipple. A peg is molded or otherwise rigidly affixed to the other of the caps at the second end of the hollow receptacle. The peg extends substantially perpendicularly to a flat base portion of the other of the caps. A suction member forming the support for the infant feeder is removably secured to a surface on which the feeder is to be mounted. The suction member includes a suction cup portion, which can be anchored securely upright to the tray surface of a high chair, and an upstanding central portion including a longitudinal bore formed therein. The peg is inserted and interlocked in the longitudinal bore either by friction or by a circumferential rib which is received within a corresponding recess in the bore to securely mount the infant feeder on the tray surface.

BRIEF DESCRIPTION OF THE DRAWINGS

The construction and operation of the infant feeder and support forming the subject matter of the instant application will be apparent when considered in conjunction with the accompanying drawing figures in which:

FIG. 1 is a view of the infant feeder as it is used to feed an infant;

FIG. 2 is a side view, partly in section, of the infant feeder and its associated support;

FIG. 3 is an exploded view of the connection between the support for and a second embodiment of the bottom cap of the infant feeder and FIG. 4 is a bottom view of the bottom cap of the infant feeder.

DESCRIPTION OF THE PREFERRED EMBODIMENT

Referring now to FIGS. 2–4, the construction of the infant feeder support of the instant invention is illustrated.

A presently known, conventional infant feeder, generally designated by reference number 10, is illustrated in FIG. 2 and includes an outer housing which, in the illustrated embodiment, consists of an endless side wall forming a hollow cylinder 12. Hollow cylinder 12 extends in a longitudinal direction around a longitudinal axis as shown. At a first, upper end of hollow cylinder 12 is disposed a top cap 14 including a rubber nipple 16 located thereon through which consumable material such as strained food can be supplied to an infant. Rubber nipple 16 is connected in a conventional manner to cap 14.

Cap 14 includes octagonal side portion 18 extending from a flat base portion 19 thereof. Internal threads 20 are provided on side portion 18 to secure cap 14 to cylinder 12. The internal threads 20 engage with external threads 22 formed on the exterior surface of cylinder 12 at the upper end thereof.

A bottom cap 24 or 24' is disposed at a second, lower end of hollow cylinder 12 opposite the first, upper end. The bottom caps illustrated in the drawing Figures are designed to replace conventional bottom caps used in known infant feeders, and each has a novel construction so as to cooperate with a suction member 70 in a manner which will become apparent. It should be clear that both embodiments of the bottom cap could be used with feeders which contain liquids as well as with those which contain strained food., Bottom caps 24 and 24' both include a flat base portion 26, 26', respectively and octagonal side portion 28, 28' extending from the base portion. Side portions 18 and 28, 28' are made octagonal for easy gripping. Side portion 28, 28' of the bottom cap includes internal threads 30 or 30', respectively, engaging with external threads 32 formed on the exterior surface of cylinder 12 to secure the bottom cap 24 or 24' to the lower end of the cylinder. Base portion 26 or 26' of the bottom cap has one or more perforations 34 or 34' drilled, molded or otherwise formed therein. A central perforation 36 may optionally be provided for a purpose which will become apparent.

Hollow cylinder 12 and caps 14 and 24 or 24', when assembled as shown in FIG. 2, form a hollow receptacle. A floating, piston-like wall 40, formed of thermoplastic resin material, is disposed within the receptacle and slides along the cylindrical, radially inner wall of hollow cylinder 12. The floating wall 40 has an edge which seals against the inner wall of the cylinder so as to prevent passage of strained food contained within a receiving chamber 42 past the wall 40.

Floating wall 40 divides the interior of the hollow receptacle formed by cylinder 12 and caps 14 and 24 or 24' into the receiving chamber 42 and an air receiving chamber 44. Chamber 42 receives the strained food which is to be consumed by the child. Air receiving chamber 44 receives air, which is allowed to flow into and out of the chamber 44 through perforations 34 as floating wall 40 slides along the inner wall of cylinder 12, and thus communicates with the atmosphere.

As previously noted, flat base portion 26 of bottom cap 24 may include central perforation 36 as well as perforations 34. In the embodiment of the invention illustrated in FIG. 2, a screw fastener 60 is passed through central perforation 36. The shank of screw fastener 60 is threadedly received in a bore located at one longitudinal end of peg 62. Peg 62 is rigidly affixed to cap 24 by the screw fastener so that peg 62 extends substantially perpendicularly to flat base portion 26. Alternatively, as illustrated in FIG. 3, bottom cap 24' and peg 62' may be integrally molded into single piece cap.

A support formed by suction member 70 is removably secured to a surface S upon which the infant feeder is to be mounted. Suction member 70 includes suction cup portion 72 and upstanding cylindrical or conical central portion 74. Central portion 74 has a longitudinal central bore 76 formed therein which receives peg 62 when the infant feeder is to be mounted on suction member 70.

Referring to FIG. 2, the manner in which the infant feeder described above is used is as follows. Top cap 14 and the associated rubber nipple 16 are unscrewed and removed from the first end of hollow cylinder 12. Strained food which is to be consumed by the infant is supplied to chamber 42 through the open first end of the cylinder until floating wall 40 abuts the flat base portion 26 of cap 24. After liquid receiving chamber 42 has been filled with liquid, top cap 14 is screwed back onto the first end of the hollow cylinder to close off the cylinder. Bottom cap 24 is then unscrewed and floating wall 40 is manually pushed toward nipple 16 to fill the nipple with food. The bottom cap is then screwed back on the second end of cylinder 12 to close the second end.

As should be apparent from FIGS. 1 and 2, suction member 70 is secured to the surface S upon which the infant feeder is to be mounted. The entire length of a peg 62 is then inserted into central bore 76 of the suction member. Insertion of the entire length of peg 62 into the central bore greatly increases the stability of the infant feeder on the upstanding portion 74 and increases resistance of the feeder to tipping. Peg 62 may be provided with one or more circumferential ribs 64 received within a corresponding recess or recesses formed in the wall of central bore 76 of the suction member. Rib 64 allows the end cap 24 to interlock with suction member 70 so that a child cannot easily pull the feeder 10 upwards out of member 70. Alternatively, to facilitate insertion of the peg into bore 76, peg 62 may be provided with a smooth exterior which frictionally engages the wall of bore 76 tightly.

The infant feeder is thus securely mounted on surface S so that the infant feeder is not easily knocked off of surface S if it is bumped or pulled by the infant. As should be clear from FIGS. 2 and 3, the upstanding central portion, has a flat end which abuts the flat base portion 26 of cap 24 or 24' for stability and resistance to tipping. Central bore 76 is coaxial with the longitudinal axis of hollow cylinder 12 so that the weight of the feeder is evenly distributed about the longitudinal axis. Suction member 70 may be removed and resecured to surface S by virtue of suction cup portion 72. The infant feeder can thus be moved to any desired location on surface, S to properly position the feeder for feeding purposes.

Referring again to FIG. 2, after the infant feeder has been properly positioned, the infant can begin to feed at its own pace. Suction member is made of rubber. The child is therefore able to move the feeder to a feeding position by flexing the upstanding central portion 74 of the suction member 70. The child draws strained food from chamber 42 through nipple 16. As strained food is consumed by the child, the suction created by the child causes floating wall 40 to slide upwardly along the cylindrical inner wall of hollow cylinder 12. Since the edge of floating wall 40 seals against the inner wall of the hollow cylinder, air within chamber 44 is prevented from entering the consumable material receiving chamber 42 and thereby from giving the child colic.

As floating wall 40 moves upwardly within cylinder 12, the volume of air chamber 44 increases, and a corresponding reduced pressure is created in the air chamber. Air at atmospheric pressure is admitted through perforations 34 into air chamber 44 in order to compensate for the increase in volume of and reduction in pressure in the air chamber and to thereby allow floating wall 40 to move easily.

After the child has consumed the strained food originally present in chamber 42, floating wall 40 abuts top cap 14 and is located in its uppermost position within cylinder 12. Floating wall 40 prevents undesirable air consumption by the child after all the food has been consumed. It is therefore unnecessary to remove the infant feeder from the child immediately after the child has consumed all the food in chamber 42.

Because of peg 62 or 62', the infant feeder of the invention is quickly and easily removable from suction member 70 for cleaning after use. It is therefore easy to avoid subjecting rubber suction member, 70, to the effects of soap or detergent by simply sliding peg 62 or 62' out of central bore 76. Caps 14 and 24 or 24' can then be removed from the ends of cylinder 12 so that the interior of the cylinder and the parts contained therein may be cleaned.

Conventional thermoplastic resin material is preferably molded to form each part described above except nipple 16 and suction member 70. Nipple 16 and suction member 70 are preferably made of either natural or synthetic rubber material.

The foregoing is to be considered as illustrative only of the principles of the invention. Since numerous modifications and changes may occur to those skilled in the art, it is not desired to limit the invention to the exact construction and operation shown and described. Accordingly, there are suitable modifications and equivalents that fall within the scope of the invention as defined by the appended claims.

I claim:

1. An infant feeder and support therefor comprising:

a hollow receptacle formed by a circumferential side wall extending in a longitudinal direction and having caps disposed at first and second ends thereof;

means within said hollow receptacle dividing the interior of said hollow receptacle into a consumable material receiving chamber and an air receiving chamber, said air receiving chamber communicating with the atmosphere;

means mounted on one of said caps at said first end of said side wall through which said consumable material is supplied from said consumable material receiving chamber to an infant;

a peg having first and second ends, and being rigidly affixed to the other of said caps at said second end of said side wall, the first end of the peg abutting and extending substantially perpendicularly from an outer surface of a flat base portion of the other of said caps; and a suction member forming the support for the infant feeder removably secured to a surface, the suction member having a suction cup portion for securing the suction member to the surface and an upstanding central portion, the upstanding central portion of said suction member including a longitudinal central bore formed therein, said second end of said peg received in said longitudinal central bore of said suction member so that said infant feeder can be securely mounted on said surface.

2. An infant feeder and support therefor comprising:

a hollow receptacle formed by a circumferential side wall extending in a longitudinal direction and having caps disposed at first and second ends thereof;

means within said hollow receptacle dividing the interior of said hollow receptacle into a consumable material receiving chamber and an air receiving chamber, said air receiving chamber communicating with the atmosphere;

mean mounted on one of said caps at said first end through which said consumable material is supplied from said consumable material receiving chamber to an infant;

a peg rigidly affixed to the other of said caps at said second end, the peg extending substantially perpendicularly to a flat base portion of the other of said caps, said peg being integrally molded with the flat base portion of the other of said caps; and a suction member forming the support for the infant feeder removably secured to a surface, the suction member having a suction cup portion for securing the suction member to the surface and an upstanding central portion, the upstanding central portion of said suction member including a longitudinal central bore formed therein, said peg received in said longitudinal central core of said suction member so that said infant feeder can be securely mounted on said surface.

3. An infant feeder and support therefor as defined by claim 2, wherein the entire length of said peg is inserted into said central bore so that a flat end of said upstanding central portion abuts said flat base portion of the other of said caps for stability.

4. An infant feeder and support therefor as defined by claim 3, wherein the means within said hollow receptacle comprises a floating wall having an edge which seals against and slides longitudinally along an inner wall of the hollow receptacle as said consumable material is supplied from said consumable material receiving chamber to the infant to prevent passage of consumable material between said consumable material receiving chamber and said air receiving chamber.

5. An infant feeder and support therefor as defined by claim 4, wherein said air receiving chamber communicates with the atmosphere via perforations formed in the other of said caps.

6. An infant feeder and support therefor as defined by claim 5, wherein a circumferential rib is provided on said peg and is receivable in a corresponding recess formed in the longitudinal central bore to secure the peg within the central bore.

* * * * *